United States Patent [19]

Kondo et al.

[11] Patent Number: 4,494,886

[45] Date of Patent: Jan. 22, 1985

[54] PRINTING DEVICE

[75] Inventors: Hiroatsu Kondo, Zushi; Toshiaki Ozawa, Chiba; Yasuaki Yamada, Matsudo, all of Japan

[73] Assignee: Canon Kabushiki Kaisha, Tokyo, Japan

[21] Appl. No.: 462,006

[22] Filed: Jan. 28, 1983

Related U.S. Application Data

[63] Continuation of Ser. No. 242,348, Mar. 10, 1981, abandoned.

[30] Foreign Application Priority Data

Mar. 17, 1980 [JP] Japan ..... 55-33590

[51] Int. Cl.[3] ..... B41J 35/28

[52] U.S. Cl. ..... 400/208; 400/212; 400/227.2; 400/249

[58] Field of Search ..... 400/239, 240, 249, 207, 400/208, 212, 227.2, 703, 711, 196.1

[56] References Cited

U.S. PATENT DOCUMENTS

| | | | |
|---|---|---|---|
| 3,346,090 | 10/1967 | Goff, Jr. et al. | 400/208 |
| 3,604,549 | 9/1971 | Caudill et al. | 400/208 |
| 3,927,747 | 12/1975 | Wolowitz | 400/208 |
| 4,115,013 | 9/1978 | Hedstrom | 400/249 |

*Primary Examiner*—Edgar S. Burr
*Assistant Examiner*—Charles A. Pearson
*Attorney, Agent, or Firm*—Fitzpatrick, Cella, Harper & Scinto

[57] ABSTRACT

A printing device having a plurality of indicating units for indicating information on the ink ribbon and having a detecting unit for ink ribbon information, with the indicating units and the detecting unit being arranged opposite to each other.

4 Claims, 2 Drawing Figures

PRINTING DEVICE

This is a continuation, of application Ser. No. 242,348, filed Mar. 10, 1981, now abandoned.

BACKGROUND OF THE INVENTION

1. Field of the Invention

The present invention relates to a printing device capable of detecting information such as an end point of and several species of.

2. Description of the Prior Art

The ink ribbons employed in the printing devices have different feeds according to the species of ribbon. A so-called one-time typing ribbon can be used only once and is fed each time by an amount approximately equal to one character. On the other hand so-called multiple typing ribbon is usable several times and is advanced each time by an amount corresponding to ½ to ⅓ of one character. For this reason a printing device designed for using these different species of ink ribbons needs to have an adjustable feed for the ink ribbon, and there also is required a means for detecting the species of the ink ribbon.

Also when using an ink ribbon it has been necessary to detect a suitable changing time for the ink ribbon, for example the arrival time of an end point of ink ribbon at the printing position, in order to maintain a satisfactory print quality. In this manner the conventional printing devices utilizing ink ribbons have required the detection of a plurality of information concerning the ink ribbon. Thus, these devices have required plural detecting means, which leads to a larger sized device and a higher cost for making the device. Besides such detecting means, which usually are composed of contact-type elements such as microswitches, are unstable and usually result in a complicated structure.

SUMMARY OF THE INVENTION

The object of the present invention is to provide a compact and inexpensive printing device.

Another object of the present invention is to provide a printing device in which one detecting means is capable of detecting a plurality of information of the ink ribbon.

Still another object of the present invention is to provide means capable of detecting the information on the ink ribbon.

Still another object of the present invention is to provide means for shifting a cassette case so as to detect different information of the ink ribbon at the printing position and at a position for confirming that printing has been completed.

DETAILED DESCRIPTION OF THE PREFERRED EMBODIMENT

Figure 1:
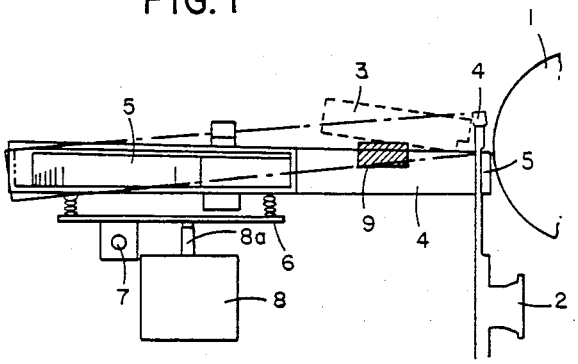
FIG. 1 is a schematic cross-sectional view of a printing device embodying the present invention.

FIG. 1 is a schematic view of a printing device embodying the present invention wherein there are shown a platen 1, a daisy-wheel type printing wheel 2, a hammer 3, a cassette 4 housing an ink ribbon 5. In the non-printing state shown in FIG. 1, the cassette 4 is in the full-lined position below the printing position in order to allow easy confirmation of the obtained print by the operator. A plate member 6 detachably supporting the cassette is rotatably supported by a shaft 7 fixed on an carriage (unshown) of the printing device. A magnetic solenoid 8 drives a plunger **8*a* to determine the position of said ink ribbon. There is also provided a detector 9** composed of a reflective photointerrupter for detecting the end point of the ink ribbon and for identifying the species thereof.

At the printing operation the solenoid 8 is energized to rotate the plate member 5 and cassette 4 about the shaft 7, whereby said cassette is lifted to a double-dotted chain line 4'. After the printing action with the hammer 3, the ink ribbon is advanced while the cassette is still lifted. The ink ribbon advancement is achieved by an unrepresented stepping motor. After the ink ribbon advancement the solenoid 8 is deactivated to return the cassette rapidly to the full-lined position 4 to enable the confirmation of the obtained print, but the cassette may also be retained in the lifted position to enter the succeeding print operation if the succeeding print signal is supplied in continuation.

Figure 2:
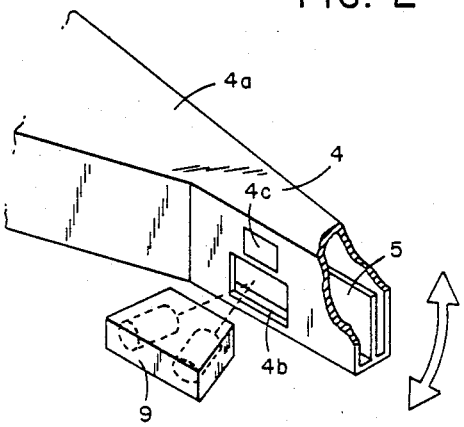
FIG. 2 is a perspective view of ink ribbon detecting means.

FIG. 2 shows a detector positioned inside a ribbon guide arm of the ribbon cassette, wherein said guide arm is provided with an indicating aperture **4*b* through which the ink ribbon 5 is directly visible. The ink ribbon 5, of normally black color, is provided with a reflective metal foil at the end points thereof whereby the detector 9 is capable of detecting the change in the reflective light. Above the indicating aperture 4*b* formed is a species indicating area 4*c*** which indicates the species of the ink ribbon, for example by a black tape for a one-time ribbon or by a reflective tape for a multiple ribbon.

When the cassette is retained at the full-lined position 4 in FIG. 1 below the printing position, the detector 9 is positioned to face the indicating area **4*c* to identify the species of the ink ribbon used, so that an unrepresented control circuit regulates the number of pulses supplied to the stepping motor according to an output signal from said detector 9. When the ribbon cassette is lifted to the position 4' in the printing operation, the detector 9 faces the aperture 4*b* to detect the state of the ink ribbon. When the reflective metal foil which indicates the end point of the ink ribbon, appears in said aperture 4*b*, the detector 9** transmits the corresponding information to the control circuit, which immediately interrupts the printing operation and gives a warning to the operator to change the ink ribbon.

In this manner the printing device of the present invention indentifies the species of the ink ribbon merely by attaching a black tape or a reflective tape to the ribbon cassette, and assures reliability since the detector is maintained contact-free even during the exchanging operation of the ink ribbon.

As explained in the foregoing, the present invention, which identifies the information concerning ink ribbon such as the end point thereof and the species of ink ribbon by means of a single detecting means, is featured by a simple structure which permits compactization and a cost reduction of the device.

It will be apparent from the foregoing explanation that a same effect can be obtained by shifting, instead, the detecting means so as to face different indicating areas.

What we claim is:

1. A printing device comprising:

a cassette for housing an ink ribbon and having a first area for indicating a first information concerning said ink ribbon and having a second area for indicating a second information concerning the ink ribbon;

means for shifting said cassette between a first position and a second position; and detecting means fixedly positioned and selectively facing either one of said first and second areas in said first and second positions and capable of detecting changes in kinds of the first and second information to be detected, said detecting means detecting only the first information when the cassette is shifted to said first position, and only the second information when the cassette is shifted to said second position.

2. A printing device according to the claim 1, wherein said detecting means is an optical detector utilizing a photoelectric converting element.

3. A printing device according to the claim 2, wherein said shifting means is an electromagnetic solenoid capable of shifting said cassette between a printing position and a print confirming position.

4. A printing device according to the claim 1, wherein said shifting means is an electromagnetic solenoid capable of shifting said cassette between a printing position and a print confirming position.

* * * * *